US012692045B2

(12) United States Patent
Marini

(10) Patent No.: US 12,692,045 B2
(45) Date of Patent: Jul. 28, 2026

(54) PACKAGE FOR CONTAINING AND DISPLAYING OF VALUABLE AND LUXURY PRODUCTS OR ITEMS

(71) Applicant: PUSTERLA 1880 S.p.A., Milan (IT)

(72) Inventor: Roberto Marini, Mantova (IT)

(73) Assignee: PUSTERLA 1880 S.P.A., Milan (IT)

( * ) Notice: Subject to any disclaimer, the term of this patent is extended or adjusted under 35 U.S.C. 154(b) by 350 days.

(21) Appl. No.: 18/327,592

(22) Filed: Jun. 1, 2023

(65) Prior Publication Data

US 2023/0391507 A1 Dec. 7, 2023

(30) Foreign Application Priority Data

Jun. 1, 2022 (IT) ..... 102022000011672

(51) Int. Cl.
*B65D 25/10* (2006.01)
*B65D 25/14* (2006.01)
*B65D 85/00* (2006.01)

(52) U.S. Cl.
CPC ..... *B65D 25/10* (2013.01); *B65D 25/14* (2013.01); *B65D 85/70* (2013.01); *B65D 2203/00* (2013.01)

(58) Field of Classification Search
CPC .. B65D 25/108; B65D 5/5059; B65D 5/5038; B65D 5/50; B65D 5/503; B65D 5/5035; B65D 5/5088
See application file for complete search history.

(56) References Cited

U.S. PATENT DOCUMENTS 3,297,191 A * 1/1967 Eastman ..... B65D 5/5059 206/508
3,836,044 A * 9/1974 Tilp ..... B65D 83/0805 206/812

(Continued)

FOREIGN PATENT DOCUMENTS

FR 3032186 A1 8/2016
FR 3053317 A1 1/2018

(Continued)

OTHER PUBLICATIONS

French Search Report for Application No. FR2305292, dated Sep. 1, 2025, 18 pages with translation.

(Continued)

*Primary Examiner* — Don M Anderson
(74) *Attorney, Agent, or Firm* — CANTOR COLBURN LLP

(57) ABSTRACT

A package for containing and/or displaying valuable and luxury products or items, includes a box-shaped body having a bottom and at least one side wall extending transversely from the bottom, the bottom and the side wall delimiting, at least partially, at least one housing compartment open on the side opposite the bottom. The package includes at least one support structure made of a paper material, insertable inside the housing compartment;

at least one housing seat engaged to the support structure for housing and/or supporting a corresponding product to be contained and/or exhibited according to a predefined position. The housing body has at least a substantially plate-like engagement portion to engage the support structure and at least one housing cavity for the accommodation of a respective product, made of a paper material, and (Continued)

the support structure has at least one main portion having at least one through opening.

13 Claims, 4 Drawing Sheets

(56) References Cited

U.S. PATENT DOCUMENTS

| | | | | |
|---|---|---|---|---|
| 10,301,097 | B2 * | 5/2019 | Groff | B65D 81/052 |
| 12,024,351 | B1 * | 7/2024 | Critchfield | B65D 81/18 |
| 2004/0140243 | A1 * | 7/2004 | Roesel | B65D 81/07 206/583 |
| 2007/0251856 | A1 * | 11/2007 | Zietlow | B65D 5/503 206/586 |
| 2013/0062245 | A1 * | 3/2013 | Folchini | A61M 5/002 493/162 |
| 2016/0136049 | A1 * | 5/2016 | Weinstein | B65D 25/04 206/570 |
| 2016/0185511 | A1 * | 6/2016 | O'Neill | B65D 5/5088 220/23.88 |
| 2016/0304235 | A1 * | 10/2016 | Herkenrath | B65D 5/545 |
| 2017/0297802 | A1 * | 10/2017 | Davis | B65D 25/101 |
| 2017/0362010 | A1 * | 12/2017 | Groff | B65D 81/052 |
| 2019/0031421 | A1 * | 1/2019 | Kneisel | B01L 9/06 |
| 2019/0352044 | A1 * | 11/2019 | Johnston | B65D 5/4237 |
| 2021/0188515 | A1 * | 6/2021 | Henigman | B65D 81/133 |
| 2021/0245917 | A1 * | 8/2021 | Evans | B65D 5/503 |
| 2022/0194651 | A1 * | 6/2022 | Cedrone | B65D 1/0246 |
| 2022/0227526 | A1 * | 7/2022 | Bonnini | B65D 5/5059 |
| 2022/0234782 | A1 * | 7/2022 | Uyeda | B65D 5/36 |
| 2022/0411132 | A1 * | 12/2022 | Catalano | B65D 5/503 |
| 2023/0219734 | A1 * | 7/2023 | Henigman | B65D 65/466 206/563 |
| 2023/0348141 | A1 * | 11/2023 | Zhurin | B65D 75/54 |
| 2023/0391507 | A1 * | 12/2023 | Marini | B65D 5/5038 |
| 2023/0413975 | A1 * | 12/2023 | Holley | B65D 77/26 |
| 2024/0132246 | A1 * | 4/2024 | Cheng | B65D 5/5021 |
| 2024/0150078 | A1 * | 5/2024 | Marini | B32B 27/10 |
| 2024/0166418 | A1 * | 5/2024 | Uyeda | B65D 5/5059 |
| 2024/0226712 | A1 * | 7/2024 | Weig | B65D 77/0413 |
| 2024/0359870 | A1 * | 10/2024 | Ootaka | B65D 25/04 |
| 2025/0214743 | A1 * | 7/2025 | Henigman | B65D 5/5038 |
| 2025/0241821 | A1 * | 7/2025 | Zhang | B65D 25/108 |
| 2025/0319470 | A1 * | 10/2025 | Sager | B65D 5/5021 |

FOREIGN PATENT DOCUMENTS

| | | | |
|---|---|---|---|
| FR | 3053318 | A1 | 1/2018 |
| FR | 3099468 | A1 | 2/2021 |
| KR | 200336283 | Y1 | 12/2003 |
| WO | 2018002795 | A1 | 1/2018 |

OTHER PUBLICATIONS

Italian Search Report and Written Opinion for Italian Application No. 102022000011672, dated Jan. 17, 2023, 7 pages.

* cited by examiner

PACKAGE FOR CONTAINING AND DISPLAYING OF VALUABLE AND LUXURY PRODUCTS OR ITEMS

CROSS-REFERENCE TO RELATED APPLICATIONS

This application claims the benefit of Italian patent application no. 102022000011672, filed on 1 Jun. 2022, the disclosure of which is incorporated herein by reference in its entirety.

TECHNICAL FIELD

The present disclosure refers to a package for containing and displaying of valuable and luxury products and items, such as perfumes, creams, alcoholic products, high-range cosmetics, high-fashion accessories and/or items, jewellery and/or similar.

The present disclosure relates to the sector of paper industry and, specifically, is aimed at packages, packs, boxes, covered boxes, caskets, cases and/or similar for containing, displaying, marketing, and selling of valuable and luxury products.

BACKGROUND

As known, presenting and displaying, as well as marketing and selling, of valuable and luxury products require equally valuable and high-quality packages which are made with attention to the smallest detail to be used.

For this purpose, packages of various forms and sizes which can be of the simple type or foldable, covered with special materials, such as particular papers and/or canvas and/or any other valuable material, or silk-screened and/or planographically printed, or provided with plastic elements being appropriately made by thermoforming processes, have been made.

An example of known package normally used for selling and/or displaying of perfumes, beauty products, alcoholics and/or similar involves the presence of at least three components, that is: a box-shaped body, a lid and a dedicated support for the products or items to be contained and/or displayed.

Generally, the box-shaped body is made of cardboard or similar paper material and is provided with a bottom from which a plurality of side walls perpendicularly extend, such that a respective housing compartment is defined.

The lid is also made of cardboard or similar paper material and has a covering wall from which a plurality of side walls extends to define a covering compartment able to accommodate at least the top part of the box-shaped body inside.

Generally, the support is entirely made of plastic, by an appropriate thermoforming process, and has a structure having one or more housing cavities, or seats, for accommodating in an engageable manner the products to be contained and/or displayed and a plurality of resting portions arranged to engage the bottom of the box-shaped body when the support is inserted inside the housing compartment of the same.

In order to visually cover most of the plastic structure of the support and meanwhile to allow the aesthetic decoration of the latter, gluing a decoration mask appropriately made of a valuable paper material on the same is a common practice. The decoration mask entirely covers the support except for the housing cavities, such as to allow to place or remove the products or items to be contained and/or displayed. The decoration mask is thus provided, for each of the housing cavities provided on the support, with a corresponding through opening having the same shape and configuration of the corresponding housing cavity.

SUMMARY

In order the solve the problems due to the excessive use of plastic in known packages, such as for example issues related to waste disposal and recycling, as well as costs for making plastic supports having dedicated configurations for particular combinations of products or items to be contained and/or displayed, as described in the Italian Patent Application No. 102016000068257 in the name of the Applicant himself, a package has been ideated, wherein the support is made of paper material such as, for example, cardboard, and wherein the housing cavities for articles or products to be accommodated are defined by bodies also made of paper material, such as pressed cardboard pulp, thus totally eliminating the use of plastic. Thereby, the package can be fully recycled without having to operate the separation of components made of materials other than paper material, such as plastic components.

However, the Applicant has found that the packages entirely made of paper material are not free from drawbacks and are improvable in several aspects.

In particular, the processes of processing and modelling the pressed cardboard pulp have more limits than the thermoforming processes adopted for making plastic supports, with relative housing cavities. Accordingly, there is a greater limitation of the forms the supports, and particularly the housing cavities of the items, can assume. The limitations to the making of housing cavities suitably conformed as a function of the form of the item to be accommodated also sets limits to the ability of the support to stably retain the item to be contained and/or displayed inside the cavity itself.

Thus, the present disclosure proposes a package for containing and displaying of valuable and luxury products or items, such as perfumes, creams, alcoholic products, high-range cosmetics, high-fashion accessories and/or items, jewellery and/or similar, able to solve the problems found in the known art.

The present disclosure reduces the environmental costs related to the use of plastic in such packages while ensuring performance equal to that obtainable in packages comprising plastic components.

The present disclosure allows the processes of making, forming, and assembling such packages to be automatized.

The present disclosure further relates to making a package being able to give the widest reliability and safety guarantees in use.

The above-mentioned and other advantages are substantially achieved by providing a package for containing and displaying of valuable and luxury products or items as set forth in claim 1.

Other features are provided in the dependent claims.

BRIEF DESCRIPTION OF THE DRAWINGS

Further features and advantages will be more apparent from the description of two preferred, but not exclusive, embodiments of a package for containing and displaying of valuable and luxury products or items, illustrated for indicative and non-limiting purposes with the aid of the attached drawings, wherein.

DETAILED DESCRIPTION OF THE DRAWINGS

Figure 1:
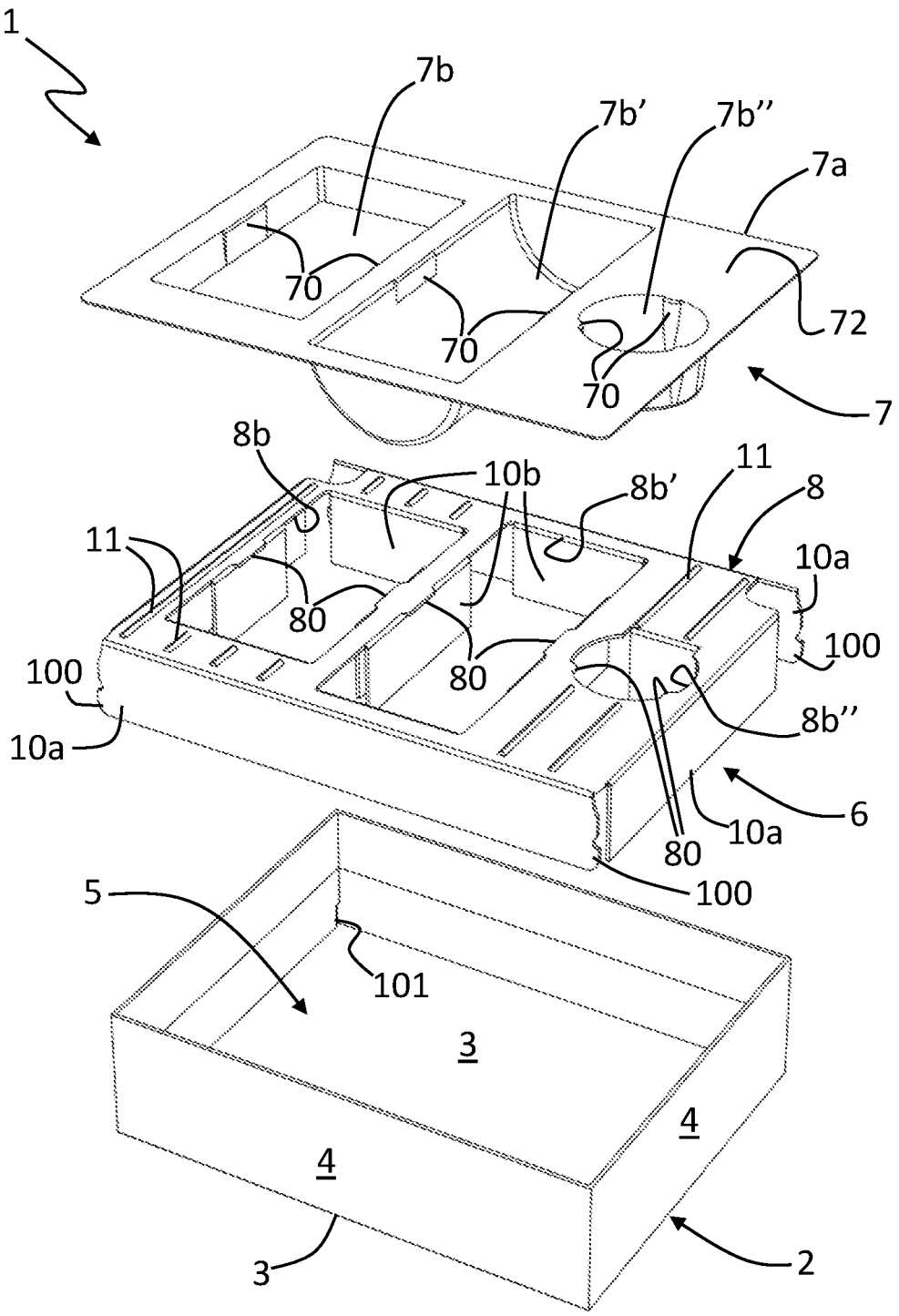
FIG. 1 is a perspective exploded representation of a first embodiment of a package, according to the disclosure.

With reference to the cited figures, the package for containing and displaying of valuable and luxury products or items, overall referred to by reference number 1, comprises:

- a box-shaped body 2 having a bottom 3 and at least one side wall 4 extending transversely, preferably perpendicularly, from the bottom 3, where the bottom 3 and the side wall 4 delimit, at least partially, at least one housing compartment 5 open on the side opposite the bottom 3;
- at least one support structure 6 made of a paper material, which can be inserted inside the housing compartment 5 of the box-shaped body 2;
- at least one housing body 7 engaged to the support structure 6 for housing and/or supporting a corresponding product P to be contained and/or exhibited according to a predefined position.

The housing body 7 comprises at least a substantially plate-like engagement portion 7*a* adapted to engage the support structure 6 and at least one housing cavity 7*b*, 7*b*', 7*b*" for the accommodation of a respective product P, made of a paper material.

Preferably such housing cavity 7*b*, 7*b*', 7*b*" is, at least partially, shaped against at least one portion of the respective product P to be contained.

Figure 2:
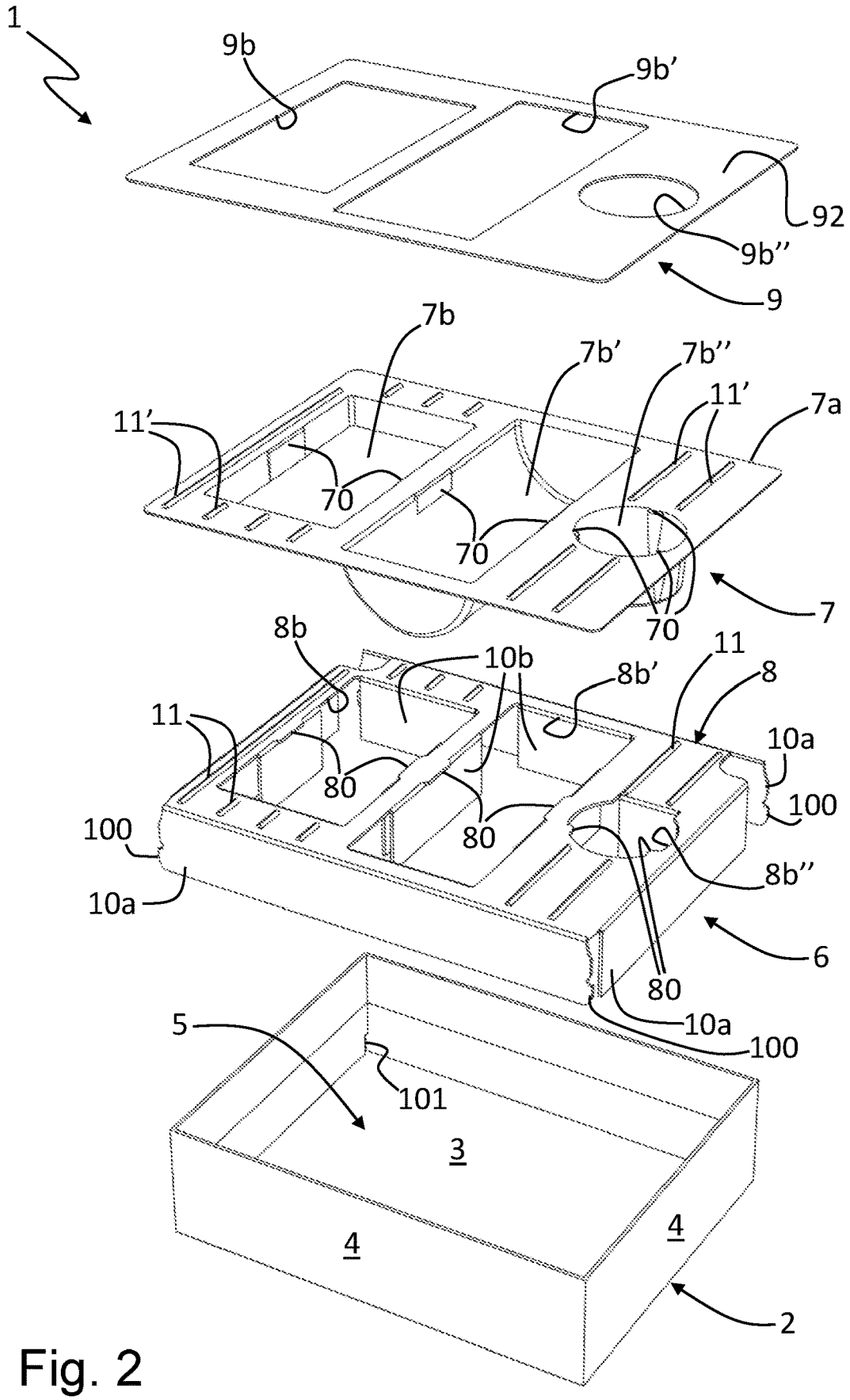
FIG. 2 is a perspective exploded representation of a second embodiment of a package, according to the disclosure.

According to the embodiments illustrated in FIGS. 1 and 2, the package 1 comprises only one housing body 7 comprising an engagement portion 7*a* and several housing cavities 7*b*, 7*b*', 7*b*". According to the embodiment illustrated in FIG. 5, instead, the package 1 comprises a plurality of housing bodies 7, in particular three, each comprising a respective engagement portion 7*a* and a respective housing cavity 7*b*, 7*b*', 7*b*".

The support structure 6 comprises at least one main portion 8 having at least one through opening 8*b*, 8*b*', 8*b*", preferably having the same shape as the housing cavity 7*b*, 7*b*', 7*b*" of the respective housing body 7.

According to the disclosure, the at least one main portion 8 of the support structure 6 comprises at least one rigid tab 80 projecting towards the inside of the through opening 8*b*, 8*b*', 8*b*". In the assembled configuration of the package 1, such at least one rigid tab 80 is configured to abut against a corresponding portion 70 of at least one wall 71 of the housing cavity 7*b*, 7*b*', 7*b*", so as to stiffen such portion 70 of the wall 71. The stiffened portion 70 is adapted to act as a matching part for the product P inside the housing cavity 7*b*, 7*b*', 7*b*", so as to retain it inside the same.

As illustrated in the attached figures, the rigid tab 80 abuts, with interference, against the outer face of the wall 71 defining the respective housing cavity 7*b*, 7*b*', 7*b*", at the portion 70 of the wall 71, conferring rigidity to the wall 71 in such zone, and thus also promoting the fixing of the housing body 7 in the support structure 6.

Preferably the at least one housing cavity 7*b*, 7*b*', 7*b*" is made of a paper material having a rigidity lower than the rigidity of the paper material in which the at least one support structure 6 is made.

Preferably, indeed, the support structure 6 is made of cardboard, while the at least one housing cavity 7*b*, 7*b*', 7*b*" of products P is made of pressed cardboard pulp.

Therefore, the rigid tab 80 is also made of cardboard, and confers rigidity to the portion 70 of the wall 71 of the respective housing cavity 7*b*, 7*b*', 7*b*", made of pressed cardboard pulp.

The at least one housing cavity 7*b*, 7*b*', 7*b*" can be also made of other materials and/or by other modes, for example by dry processes. In particular, preferably the at least one housing cavity 7*b*, 7*b*', 7*b*" can be made in any material being at least partially deformable.

Preferably, the at least one wall 71 of the respective housing cavity 7*b*, 7*b*', 7*b*" is configured to deform due to the insertion of the product P inside the housing cavity 7*b*, 7*b*', 7*b*" itself, where however the deformation of the portion 70 of the wall 71 is limited by the presence of the rigid tab 80. In other words, the housing cavity 7*b*, 7*b*', 7*b*" is deformed except for the portion 70 stiffened by the presence of the underlying rigid tab 80. Thereby, the retaining of the product P, through the stiffened portion 70, inside the respective housing cavity 7*b*, 7*b*', 7*b*" is further promoted, even in view of possible deformations the housing cavity 7*b*, 7*b*', 7*b*' can be subjected to.

Figure 3A:
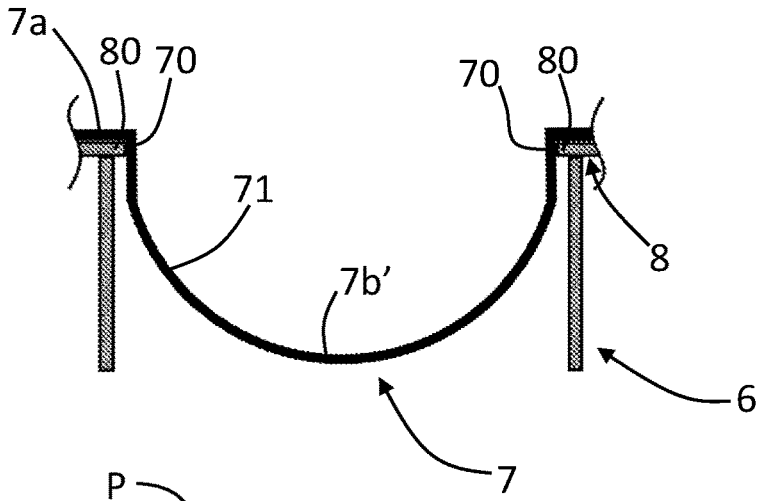
FIGS. 3*a* and 3*b* are a schematic representation of a section of the package, according to the disclosure, in two use configurations, respectively in the absence and presence of an item housed in the housing cavity.
Figure 3B:
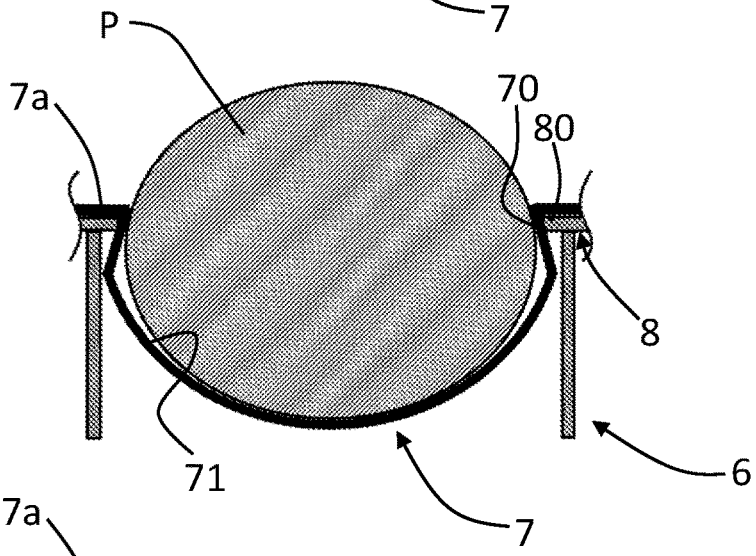

Such effect is schematically shown in FIGS. 3*a* and 3*b*. By using the deformability of the wall 71 defining the housing cavity 7*b*', such cavity can be configured so that such wall 71 is deformed by adapting to the form of the inserted product P itself. However, such deformation due to the insertion of the product P inside the cavity 7*b*' does not produce a deformation of the portion 70 of the wall 71, at the through opening 8*b*' formed in the support structure 6, because of the stiffening conferred by the underlying rigid tab 80. Thereby, the product P can be always stably retained inside the housing cavity 7*b*'.

Preferably the at least one main portion 8 of the support structure 6 comprises at least two rigid tabs 80 projecting towards the inside of the corresponding through opening 8*b*, 8*b*', 8*b*".

Such rigid tabs 80 are preferably opposite of each other.

In particular, depending on the form taken by the housing cavity 7*b*, 7*b*', 7*b*" such rigid tabs 80 can be placed opposite to each other on opposite sides of the through opening, as in the case of the through openings 8*b* and 8*b*', or arranged at a desired angular distance, as in the case of the through opening 8*b*".

Preferably, the at least one rigid tab 80 is configured to deform the portion 70 of the wall 71 of the respective housing cavity 7*b*, 7*b*', 7*b*" when such cavity 7*b*, 7*b*', 7*b*" is inserted in the support structure 6.

Figure 4:
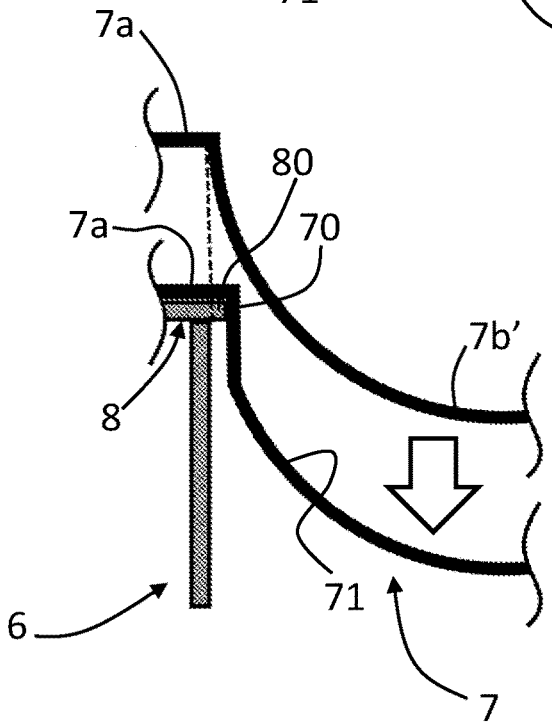
FIG. 4 schematically shows how the assembling of two components of the package occurs, according to a variation of the disclosure.

Such effect is schematically shown, in an accentuated manner, in FIG. 4: inserting the housing body 7 inside the support structure 6 involves that the portion 70 of the wall 71 defining the respective cavity 7*b*' deforms due to the presence of the rigid tab 80.

In this way, for example, in the wall 71 of the housing cavity 7*b*, 7*b*', 7*b*", at the rigid tab 80, a deformation of the wall 71 itself can be created, such as to make an undercut zone, moreover stiffened by the presence of the underlying rigid tab 80, adapted to retain the product P inside the cavity 7*b*, 7*b*', 7*b*".

Preferably, the portion 70 of the wall 71 is at least partially shaped against the rigid tab 80 associated with it. In this way, the rigid tab 80 also acts as a guide for inserting the housing body 7 inside the support structure 6.

Figure 5:
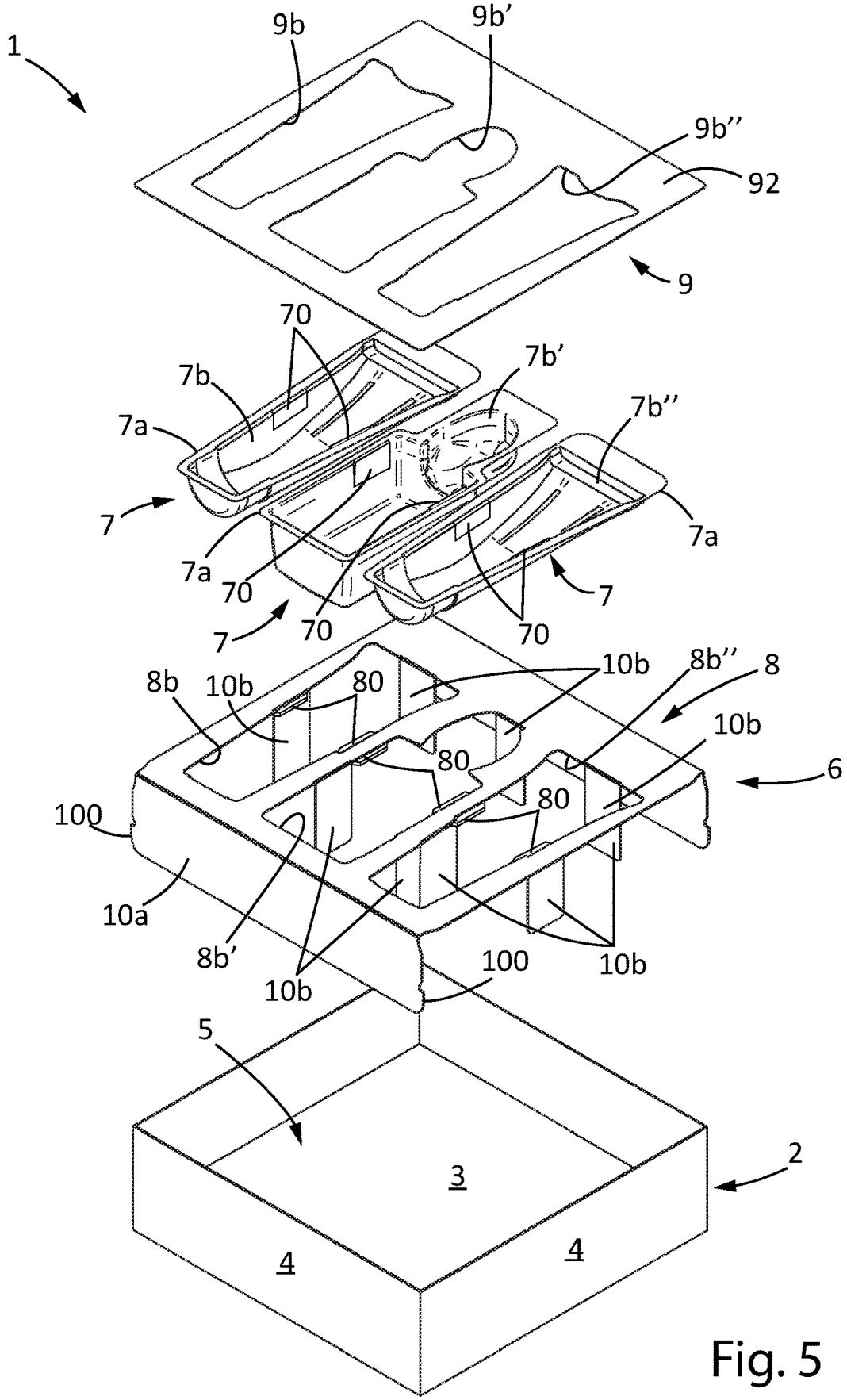
FIG. 5 is a perspective exploded representation of a third embodiment of a package, according to the disclosure.

As illustrated in FIGS. 1, 2 and 5, the portions 70 of the walls 71 of the housing cavities 7*b*, 7*b*', 7*b*" have a form substantially complementary to the form of the tabs 80 associated with them.

For example, with reference to FIGS. 1 and 2, the tabs 80 at the through openings 8*b* and 8*b*' have a substantially rectangular (or isosceles trapezium) top plan form, while the tabs 80 at the through opening 8*b*" have a substantially semi-circular top plan form. With reference to FIG. 5, indeed, the tabs 80 at the through openings 8*b*, 8*b*', 8*b*" all have a substantially rectangular (or isosceles trapezium) top plan form. The corresponding portions 70 of the walls 71 of the housing cavities 7*b*, 7*b*' and 7*b*" have a form substantially complementary to those of the tabs 80 associated with them.

As illustrated in FIGS. 1, 2 and 5, the box-shaped body 2 is provided with a bottom 3 whose shape is substantially rectangular and with four side walls 4 developing substantially perpendicularly from the bottom 3, according to a configuration opposite of each other. For the purpose of the present disclosure, the shape of the bottom 3 of the box-shaped body 2 and the number of the side walls 4 are irrelevant, whereby the box-shaped body 2 can have any conformation.

The package 1 further comprises a lid (not visible in the attached figures) engageable, in particular which can be fitted from top to bottom, to the box-shaped body 2 to close the housing compartment 5, of a form appropriate to that of the box-shaped body 2.

Preferably, the housing body 7 is made as a monolithic piece of paper material, and preferably comprises a plurality of housing cavities 7*b*, 7*b*', 7*b*". Alternatively, the housing body 7 is made as a monolithic piece of paper material but comprises only one respective housing cavity 7*b*, 7*b*', 7*b*". As illustrated in the attached figures, such housing cavities 7*b*, 7*b*', 7*b*" can have different forms depending on the form of the product P housed therein.

Advantageously, as particularly illustrated in FIG. 1, with reference to the first embodiment, the substantially plate-like engagement portion 7*a* has an exposed surface 72 adapted to remain facing the side opposite to the bottom 3 of the box-shaped body 2 when the support structure 2 is inserted inside the housing compartment 5 of the latter. Such exposed surface 72 can comprise an aesthetic decoration and/or a valuable surface finishing.

Advantageously, as illustrated in particular in FIGS. 2 and 3, with reference to the second and third embodiments, the package 1 can comprise an auxiliary element 9 having at least one through opening 9*b*, 9*b*', 9*b*" overlapping with the support structure 6 and the housing body 7. Such auxiliary element 9 has an exposed surface 92 adapted to remain facing the side opposite to the bottom 3 of the box-shaped body 2 when the support structure 2 is inserted inside the housing compartment 5 of the latter. Such exposed surface 92 can comprise an aesthetic decoration and/or a valuable surface finishing. The auxiliary element 9 can be preferably made of a valuable paper material.

The at least one through opening 9*b*, 9*b*', 9*b*" preferably has the same shape as the corresponding housing cavity 7*b*, 7*b*', 7*b*".

Preferably, the area defined by the shape of the at least one through opening 9*b*, 9*b*', 9*b*" is lower than the area defined by the shape of the corresponding housing cavity 7*b*, 7*b*', 7*b*".

In other words, the shapes have the same form but the areas defined by the shapes of the through openings 9*b*, 9*b*', 9*b*" are lower than those of the shapes of the corresponding housing cavities 7*b*, 7*b*', 7*b*" such that the product P is retained by the auxiliary element 9 inside the housing cavity 7*b*, 7*b*', 7*b*".

Preferably, the housing body 7 can be associated with the support structure 6 through at least one gluing substance 11 or a similar jointing substance. As illustrated in the attached figures, the gluing substance 11 is interposed between the main portion 8 of the support structure 6, and the engagement portion 7*a* of the housing body 7.

With specific reference to the second embodiment of the disclosure, illustrated in FIG. 2, the auxiliary element 9 can be also associated with the housing body 7 through at least one gluing substance 11' or a similar jointing substance. The gluing substance 11' is interposed between the engagement portion 7*a* of the housing body 7 and the lower face of the auxiliary element 9.

The gluing substance can be also provided in the third embodiment, even if not illustrated.

According to an advantageous aspect of the present disclosure, the gluing or jointing substance 11, 11' comprises at least one water-based vinyl glue or an animal glue or a similar glue suitable for waste disposal and recycling.

As visible in FIGS. 1, 2 and 5, the support structure 6 comprises a plurality of resting portions 10*a*, 10*b*. At least two resting portions 10*a* extend from opposite ends of the main portion 8, while the remaining resting portions 10*b* extend from the edges of one or more of the respective through openings 8*b*, 8*b*', 8*b*" of the main portion 8.

Advantageously, all the resting portions 10*a*, 10*b* are obtained by folding structural parts of the main portion 8 of the support structure 6.

Such resting portions 10*a*, 10*b* are configured to rest on the bottom 3 of the box-shaped body 2.

Preferably, the rigid tabs 80 are formed at the resting portions 10*b* extending from the edges of one or more of the respective through openings 8*b*, 8*b*', 8*b*" of the main portion 8.

As illustrated in FIGS. 1, 2 and 5, at least two opposite resting portions 10*a* are configured to match with the side walls 4 of the box-shaped body 2.

Preferably at least one of such resting portions 10*a* can comprise at least one tab 100 projecting towards a side wall 4 of the box-shaped body 2, configured to be inserted in a corresponding seat 101 formed in such side wall 4.

In this way, the support structure 6 can be stably inserted inside the box-shaped body 2, because of the engagement of the tabs 100 in the corresponding seats 101.

Preferably two tabs 100 projecting from opposite sides of the same resting portion 10*a* are provided.

It has been practically found that the package for containing and/or displaying of valuable and luxury products or items, according to the present disclosure, solves the problems found in the known art and ensures important advantages.

First, without providing any component made of plastic, the package object of the present disclosure allows the high, particularly environmental, costs related to the use of such material to be eliminated.

Additionally, while being made of paper material, the package object of the present disclosure has the advantage to ensure performance equal to that obtainable in packages comprising plastic components, for example in terms of ability to stably retain the products in the dedicated housing seats.

Another advantage of the package, according to the disclosure, consists in significantly facilitating the relative process of forming and producing the same, as it allows the steps of assembling the packages being produced to be remarkably automatized.

A further advantage of the package, according to the disclosure, consists in allowing valuable decorations and finishing to be applied.

The package for containing and/or displaying of valuable and luxury products or items thus conceived is subject to a number of modifications and variations, all falling within the scope of the inventive concept.

Furthermore, all the details can be replaced by other technically equivalent elements.

In practice, the employed materials, as long as compatible with the specific use, as well as the contingent sizes and forms, will be whatever depending on the requirements.

The invention claimed is:

1. A package for containing and/or displaying of valuable and luxury products or items, comprising:

a box-shaped body having a bottom and at least one side wall extending transversely from the bottom, the bottom and the side wall delimiting, at least partially, at least one housing compartment open on the side opposite the bottom;

at least one support structure made of a paper material, which can be inserted inside the at least one housing compartment of the box-shaped body;

at least one housing body engaged to the support structure for housing and/or supporting a corresponding product to be contained and/or exhibited according to a predefined position, wherein said at least one housing body comprises at least an engagement portion adapted to engage the support structure and at least one housing cavity for the accommodation of a respective product, said at least one housing cavity being made of a paper material, and wherein the support structure comprises at least one main portion having at least one through opening, having the same shape as the housing cavity of the respective housing body;

wherein said at least one main portion of said support structure comprises at least one rigid tab projecting towards the inside of said at least one through opening, said at least one rigid tab being configured to abut against a respective corresponding portion of at least one wall of said at least one housing cavity so as to stiffen said respective corresponding portion of said at least one wall, said respective corresponding portion of said at least one wall being adapted to retain said product inside said at least one housing cavity.

2. The package according to claim 1, wherein said at least one housing cavity is made of a paper material having a rigidity lower than the rigidity of the paper material in which said at least one support structure is made.

3. The package according to claim 1, wherein said at least one support structure is made of cardboard, and said at least one housing cavity is made of pressed cardboard pulp.

4. The package according to claim 1, wherein said at least one wall of said at least one housing cavity is configured to deform due to the insertion of said product inside said at least one housing cavity, where the deformation of said respective corresponding portion of said at least one wall is limited by the presence of said at least one rigid tab.

5. The package according to claim 1, wherein said at least one main portion of said support structure comprises at least two rigid tabs projecting towards the inside of said at least one through opening.

6. The package according to claim 1, wherein said at least one rigid tab is configured to deform said respective corresponding portion of said at least one wall of said at least one housing cavity when said at least one housing cavity is engaged in said support structure.

7. The package according to claim 1, wherein said at least one housing body is made as a monolithic piece of paper material and comprises a plurality of housing cavities.

8. The package according to claim 1, wherein said respective corresponding portion of said wall is at least partially shaped against said at least one rigid tab associated with it.

9. The package according to claim 1, comprising an auxiliary element having at least one through opening overlapping with said support structure and said housing body.

10. The package according to claim 9, wherein said auxiliary element has an exposed surface adapted to remain facing the side opposite to the bottom of the box-shaped body when the support structure is inserted inside the housing compartment, said exposed surface comprising an aesthetic decoration and/or surface finishing.

11. The package according to claim 7, wherein said at least one through opening has the same shape of the corresponding housing cavity.

12. The package according to claim 11, wherein the area defined by said shape of said at least one through opening is lower than the area defined by the shape of the corresponding housing cavity.

13. The package according to claim 9, wherein the auxiliary element is associated with the housing body through at least one gluing substance, interposed between the engagement portion of the housing body and lower face of the auxiliary element.

* * * * *